US006180884B1

(12) United States Patent
Tokunaga et al.

(10) Patent No.: US 6,180,884 B1
(45) Date of Patent: Jan. 30, 2001

(54) SIMPLIFIED DISTRIBUTION OF CABLES IN A COMPUTER DESK DEVICE

(75) Inventors: Masato Tokunaga; Kiyomitsu Ohba; Yoshihiro Takasawa, all of Tokyo (JP)

(73) Assignees: NEC Corporation; TSC Co., Ltd., both of Tokyo (JP)

( * ) Notice: Under 35 U.S.C. 154(b), the term of this patent shall be extended for 0 days.

(21) Appl. No.: 09/252,881

(22) Filed: Feb. 18, 1999

(30) Foreign Application Priority Data

Feb. 20, 1998 (JP) ..... 10-038854

(51) Int. Cl.[7] ..... H02G 3/18

(52) U.S. Cl. ..... 174/65 R; 174/135; 174/68.1; 108/50.01; 312/223.6

(58) Field of Search ..... 174/65 R, 135, 174/60, 68.1, 48, 65 G, 65 SS; 108/50.01, 50.02; 312/223.6; 16/2.1, 2.2

(56) References Cited

U.S. PATENT DOCUMENTS 4,762,072 * 8/1988 Boundy et al. ..... 108/50.02
5,243,136 * 9/1993 Chen ..... 55/491
5,265,952 * 11/1993 Greshem et al. ..... 312/312
5,526,756 * 6/1996 Watson ..... 108/147
5,693,908 * 12/1997 Amberger ..... 174/48
5,844,775 * 12/1998 Lundberg ..... 361/683
5,845,587 * 12/1998 Ditonto ..... 108/50.01
5,896,817 * 4/1999 Hancock ..... 108/50.01

FOREIGN PATENT DOCUMENTS

3132015 * 10/1982 (DE) ..... 108/50.02

* cited by examiner

*Primary Examiner*—Kristine Kincaid
*Assistant Examiner*—Dhiru R Patel
(74) *Attorney, Agent, or Firm*—Sughrue, Mion, Zinn, Macpeak & Seas, PLLC

(57) ABSTRACT

A computer desk device provides a back board that is arranged on the rear side of a desktop on which a computer is to be installed. A common power supply cable and common network cable which are to be connected to the computer are accommodated in the back board, thus removing the need for construction work for wiring on the floor or below the floor surface and achieving a reduction in the labor and expense of wiring as well as a great reduction in the amount of time needed for wiring.

10 Claims, 6 Drawing Sheets

SIMPLIFIED DISTRIBUTION OF CABLES IN A COMPUTER DESK DEVICE

BACKGROUND OF THE INVENTION

1. Field of the Invention

The present invention relates to a computer desk device suitable for a network system using computers for use in a school or office environment.

2. Description of the Related Art

As shown in FIG. 1, in a conventional computer desk device, network cables 104 are connected to computer 103 installed on desk unit 102. Network cables 104 are secured to the back surface of desk unit 102 by securing hardware 105, pass through cable hole 106 formed in the floor and are arranged inside wiring groove 107 formed below the floor surface.

Network junction box 108 is placed inside wiring groove 107 as shown in FIG. 2. Network cables connected to other computers (not shown) are also connected to network junction box 108 in addition to network cable 104 connected to computer 103. A plurality of the computers are thus interconnected to make up a network system.

The conventional computer desk device is disadvantageous in that since, holes for cables and grooves for wiring must be provided on the floor or below the floor surface, considerable time and expense are required for wiring preparation and for the actual wiring.

Furthermore, the addition of desk units or alteration of the layout of computer desk devices also necessitates extensive reconstruction of the floor for reworking the wiring grooves in the floor. On the other hand, limiting floor construction work to a minimum imposes severe constraints on the layout of desk units or computer desk devices. Devices of the prior art have therefore been unable to flexibly cope with the addition of desk units or changes in computer layout.

SUMMARY OF THE INVENTION

It is an object of the present invention to provide a computer desk device which enables simplified preparation for wiring and actual wiring of network cables and easy additions or changes in layout.

The computer desk device according to the present invention includes a desktop on which a computer is to be installed, and a cable accommodating means provided on the desktop for accommodating cables to be connected to computers. Such an arrangement obviates the need for preparatory work for wiring in the floor and below the floor surface, thereby greatly reducing both wiring expenses and wiring time. In addition, computer desks can be freely arranged on the floor space without taking wiring routes below the floor surface into consideration, and changes in a layout can be easily done. Finally, the proximity of the cable accommodating means to the computer installed on the desktop facilitates both the routing of the various cables to the computer and the organization of cables in the vicinity of the computer.

According to one embodiment on the present invention, the cables include at least a common power supply cable that supply power to the computer and the common network cable to which the computer is connected, and the cable accommodating means include a first cable accommodating portion for accommodating common power supply cable and a second cable accommodating portion for accommodating common network cable. The common power supply cable and the common network cable are thus separately wired inside the cable accommodating means, thereby improving the workability of maintaining the cable accommodating means.

According to another embodiment on the present invention, a network junction box to be connected to common network cables and that connects the computers is arranged in the second cable accommodating part. A plurality of computers are connected by way of a network junction box to enable the transmission and reception of data between the computers.

According to another embodiment, the first cable accommodating portion and the second cable accommodating portion are each made of a cable accommodating member with an approximately U-shaped cross-section, and a stepped portion that forms a depression for accommodating common power supply cables or common network cables and is formed in the bottom surface of a cable accommodating member.

Since, for example, the common power supply cable can be accommodated within the depression and the power supply taps to which the common power supply cables connect can be placed on the stepped portion, the power supply taps do not lie directly on the common power supply cables, and plugs can be easily inserted into the power supply taps. In addition, cable connection to a network junction box is facilitated because the network junction box does not lie directly on the common network cables even in a case in which a network junction box is arranged on the second cable accommodating part.

According to another embodiment, a protective cover is provided for covering the first cable accommodating part and second cable accommodating part in the cable accommodating means.

According to another embodiment, a surplus cable length accommodating portion for accommodating the surplus length of cables is provided in the cable accommodating means.

According to another embodiment, in the cable accommodating means is provided with an opening for leading cables out of the cable accommodating means or for leading external cables connected to cables into the cable accommodating means.

Alternatively, a surplus cable length accommodating part for accommodating surplus cable portions may be provided in the cable accommodating means in the vicinity of the desktop; and an opening may be provided in the surplus cable length accommodating part for leading cables out of the cable accommodating means or for leading external cables connected to cables into the cable accommodating means.

According to another embodiment, the opening is substantially of the same width as the cable accommodating means in the direction along one edge of the desktop. Thus, cables may be led out from the opening at any position or external cables led into the cable accommodating means from the opening at any position, thereby allowing cables to be freely wired according to the layout of computer desk devices or arrangement of computers.

According to another embodiment, a cover member that covers the opening and that is made of an elastic material is provided in the cable accommodating means. The cover member usually covers the opening, and is deformed, so that cables can be easily introduced into the opening when cables are to pass through the opening.

The above and other objects, features and advantages of the present invention will become apparent from the following description with reference to the accompanying drawings which illustrate examples of the present invention.

DETAILED DESCRIPTION OF THE PREFERRED EMBODIMENTS

Figure 1:
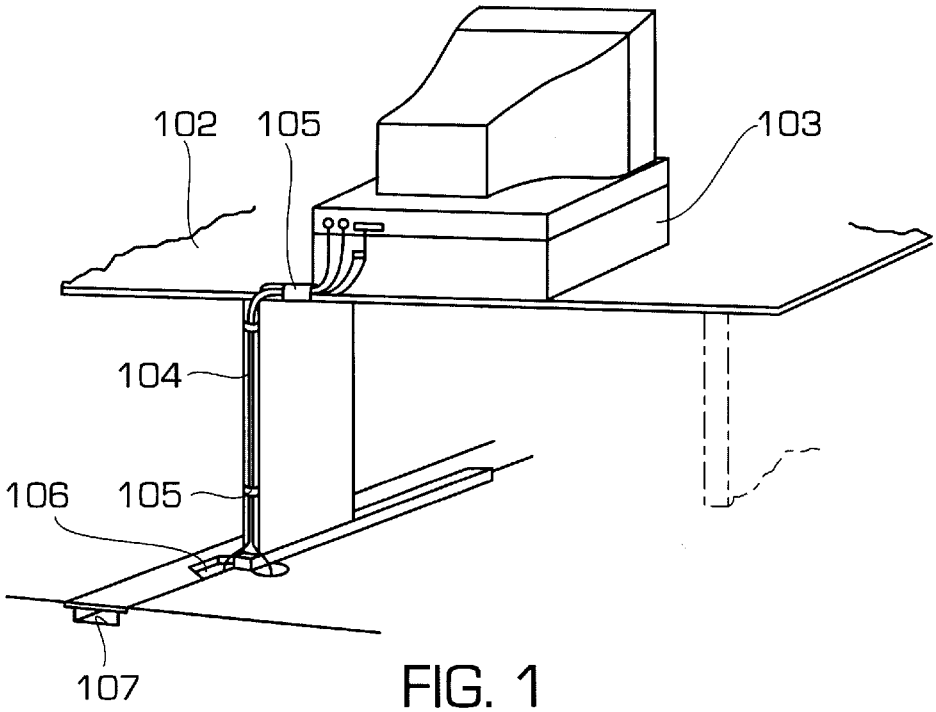
FIG. 1 PRIOR ART
FIG. 1 is a perspective view showing a computer desk device of the prior art.
Figure 2:
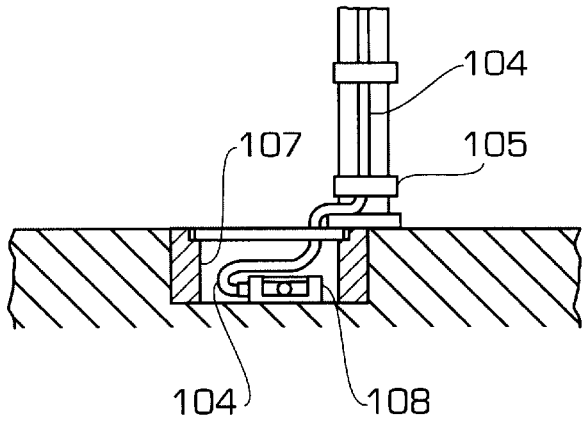
FIG. 2 PRIOR ART
FIG. 2 is a enlarged sectional view showing the construction inside the wiring groove provided in the floor in the computer desk device shown in FIG. 1.
Figure 3:
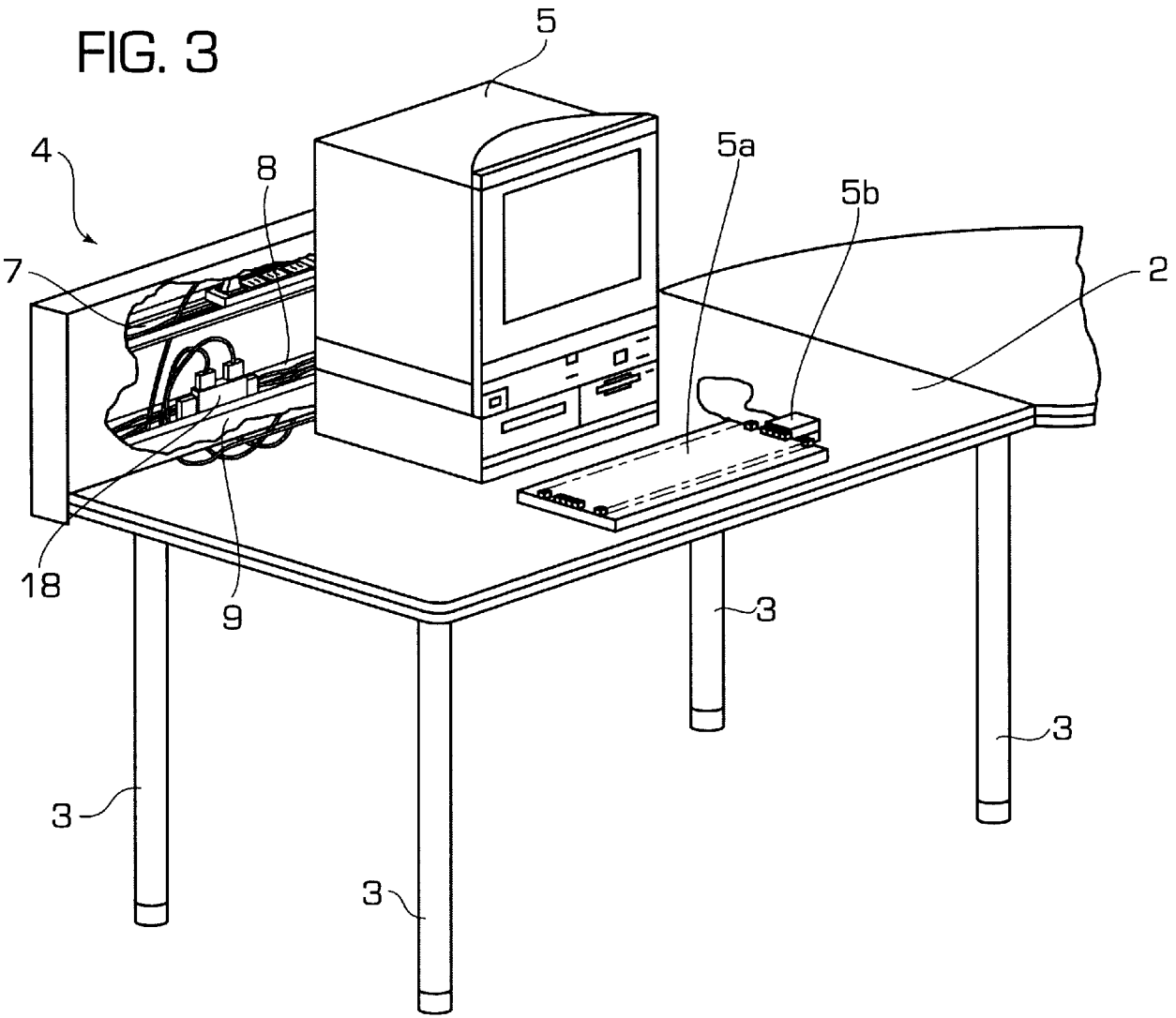
FIG. 3 is a perspective view showing a computer desk device according to an embodiment of the present invention.

Referring to now FIG. 3,there is shown a computer desk device according to an embodiment of the present invention. The computer desk device includes a desktop 2 on which computer 5 is installed, and a back board 4 attached on the rear side of a desktop 2 which functions as a cable accommodating means for accommodating various cables. Computer 5 as well as keyboard 5*a*, mouse 5*b*, and other associated components are set up on desktop 2. A plurality of legs 3 support the desktop 2.

Contained within back board 4 is a first cable accommodating portion 7 that accommodates common power supply cable 6 for supplying power to a plurality of computers. Also provided below first cable accommodating portion 7 and a second cable accommodating portion 9 that accommodates common network cable 8 to which the plurality of computers are to be connected. In addition, a surplus cable length accommodating portion 11 is provided in the vicinity of desktop 2 (see FIG. 3) and below second cable accommodating portion 9 for accommodating surplus cable length 10 of the surplus length of either common power supply cable 6 or common network cable 8.

First cable accommodating part 7 and second cable accommodating part 9 are made up of cable accommodating members 7*a* and 9*a* with an approximately U-shaped cross-section, respectively. Depressions 7*b* and 9*b* for accommodating cable 6 and 8 are formed on the bottom surfaces of these cable accommodating members 7*a* and 9*a*, respectively. To this end, each of cable accommodating members 7*a* and 9*a* is of a structure having a stepped portion and having an open upper surface. In addition, each of cable accommodating members 7*a* and 9*a* are of a length substantially equal to the width of desktop 2 (see FIG. 3). Each of cable accommodating members 7*a* and 9*a* has its end secured to column members 12 which are attached to base member 4*a* to be described hereinbelow. Column member on the left side of the figure is not shown.

Passage holes (not shown) are formed on the bottom surfaces of cable accommodating member 7*a* and cable accommodating member 9*a*. These passage holes serve to lead common power supply cable 6 accommodated in first cable accommodating part 7 or common network cable 8 accommodated in second cable accommodating part 9 to surplus cable length accommodating part 11.

Guide members 13 and 14 that project above each of cable accommodating parts 7 and 9 are additionally provided on first cable accommodating part 7 and second cable accommodating part 9, respectively. These guide members 13 and 14 serve to prevent common power supply cable 6 which is once accommodated in first cable accommodating part 7 or common network cable 8 which is once accommodated in second cable accommodating part 9 from falling out of each of cable accommodating parts 7 and 9, respectively. To this end each guide member is made of a rod material of small diameter bent into a rectangular shape. The shapes of guide members 13 and 14, however, should not be limited, and may be simply configured, for example, as rod material or plate material standing on the side walls of each of cable accommodating parts 7 and 9.

Power supply tap 16 to which common power supply cable 6 is to be connected is equipped on the stepped portion of cable accommodating member 7*a* that makes up first cable accommodating part 7. Plug sockets 17 of power supply cables 24, which are the external cables connected to individual computers, are connected to power supply tap 16 to supply computer with power.

Network junction box 18 to which common network cable 8 is to be connected is arranged on depression 9*b* of cable accommodating member 9*a* that makes up second cable accommodating part 9. Network cables 23, which are external cables connected to each of the computers, are also connected to network junction box 18. A plurality of computers are thus interconnected by way of network junction box 18, thereby enabling mutual exchange of data.

Surplus cable length accommodating portion 11 is formed between cable accommodating member 9*a* and base member 4*a* arranged on the lowermost portion of back board 4. Base member 4*a* is arranged such that the top of base member 4*a* substantially coincides with the top of desktop 2 (see FIG. 3). In addition, opening 11*a* is provided in the surface of surplus cable length accommodating part 11 that confronts desktop 2 for leading each of cables 6 and 8 out from back board 4 or for leading network cables 23 or power supply cables 24 into back board 4. Opening 11*a* is provided in the direction of the edge of desktop 2 and has substantially the same width as the width of back board 4. Opening 11*a* is covered by cover member 15 installed on both lower sides of cable accommodating member 9*a*. This cover member 15 is made of an elastic material such as plastic and can be flexibly deformed when introducing various cables into opening 11*a* as described hereinbelow.

Figure 4:
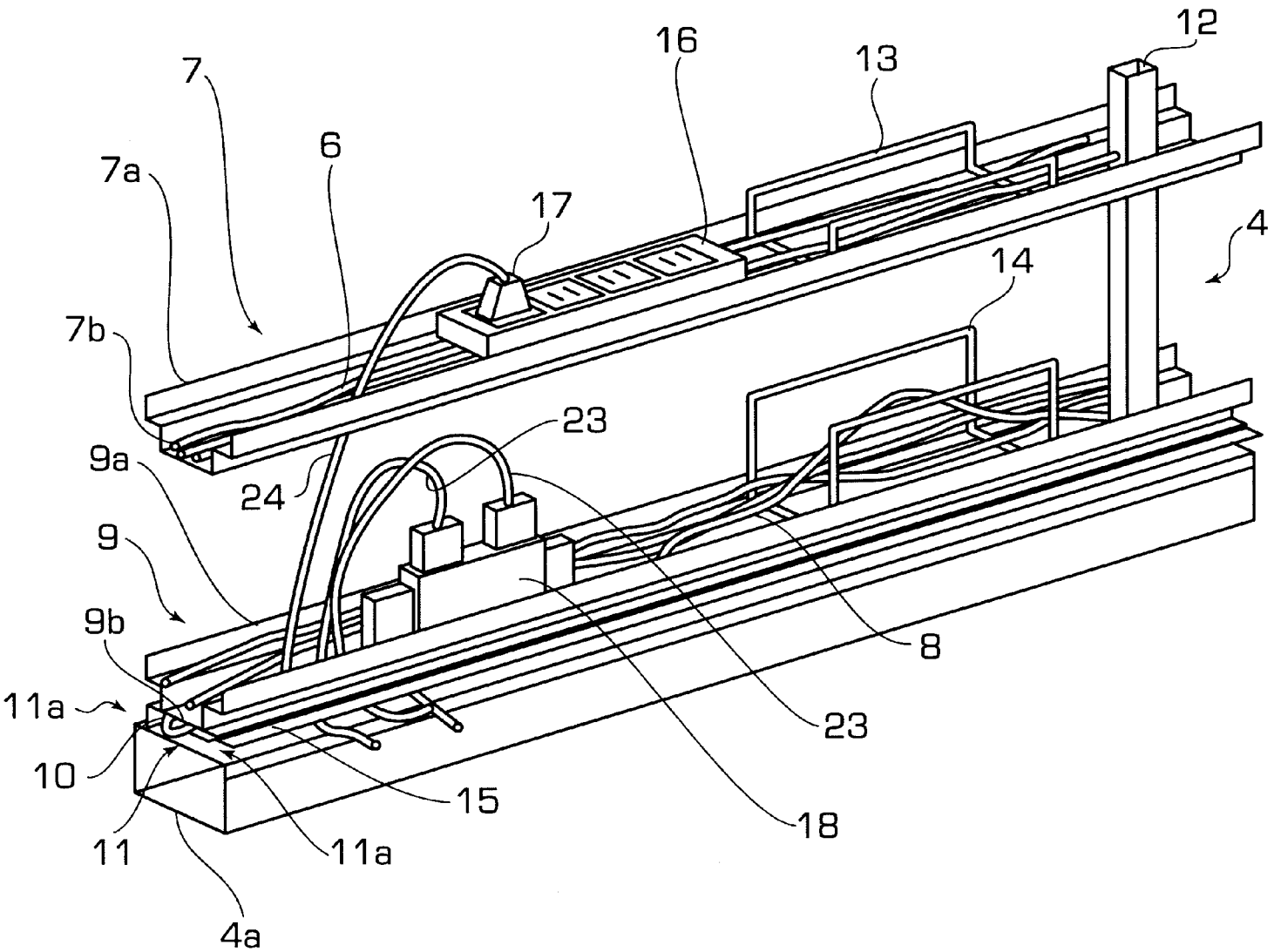
FIG. 4 is a perspective view showing the internal construction of the back board shown in FIG. 3.
Figure 5:
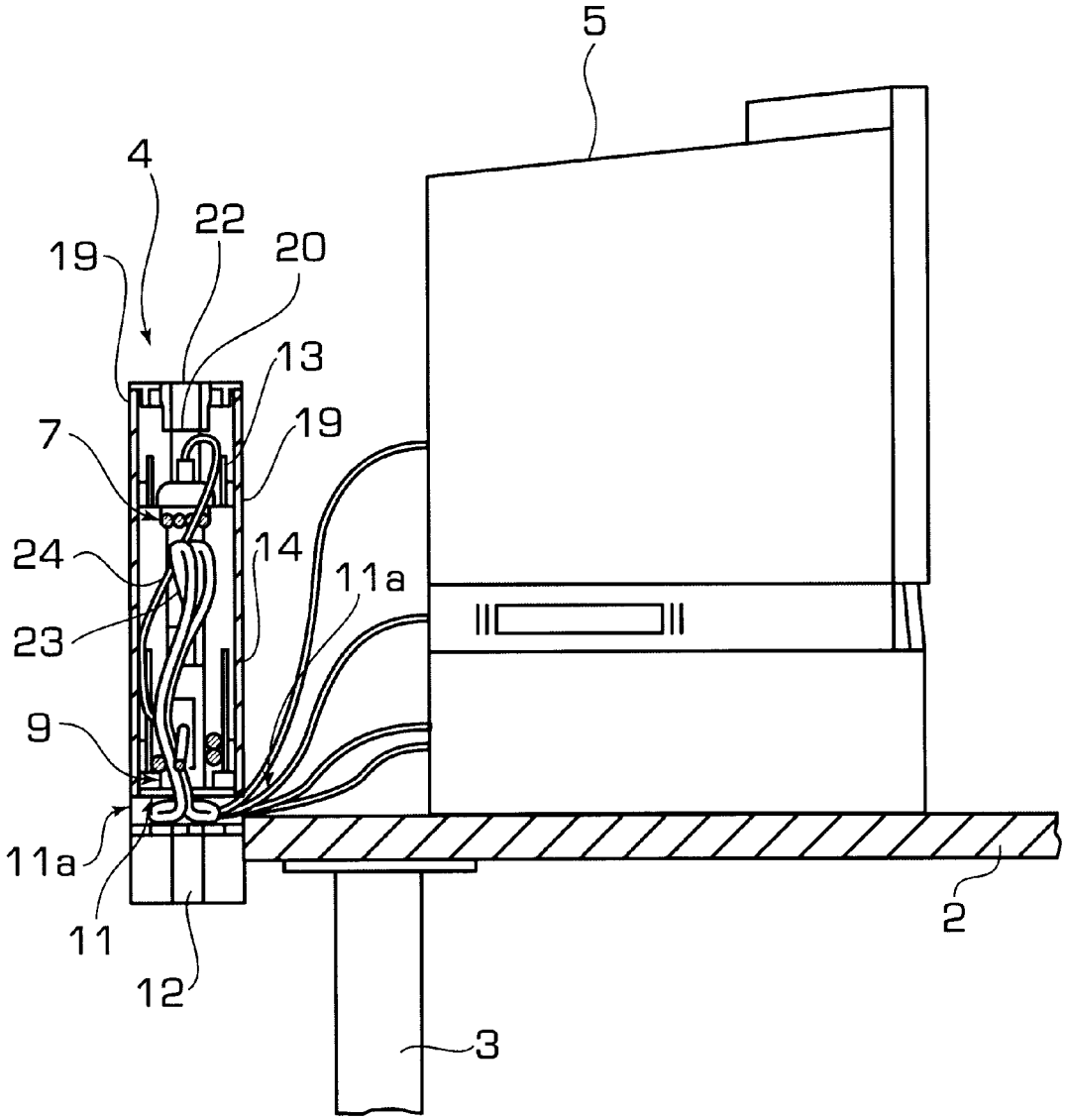
FIG. 5 is a view showing a cutaway of a portion of the computer desk device shown in FIG. 3.
Figure 6:
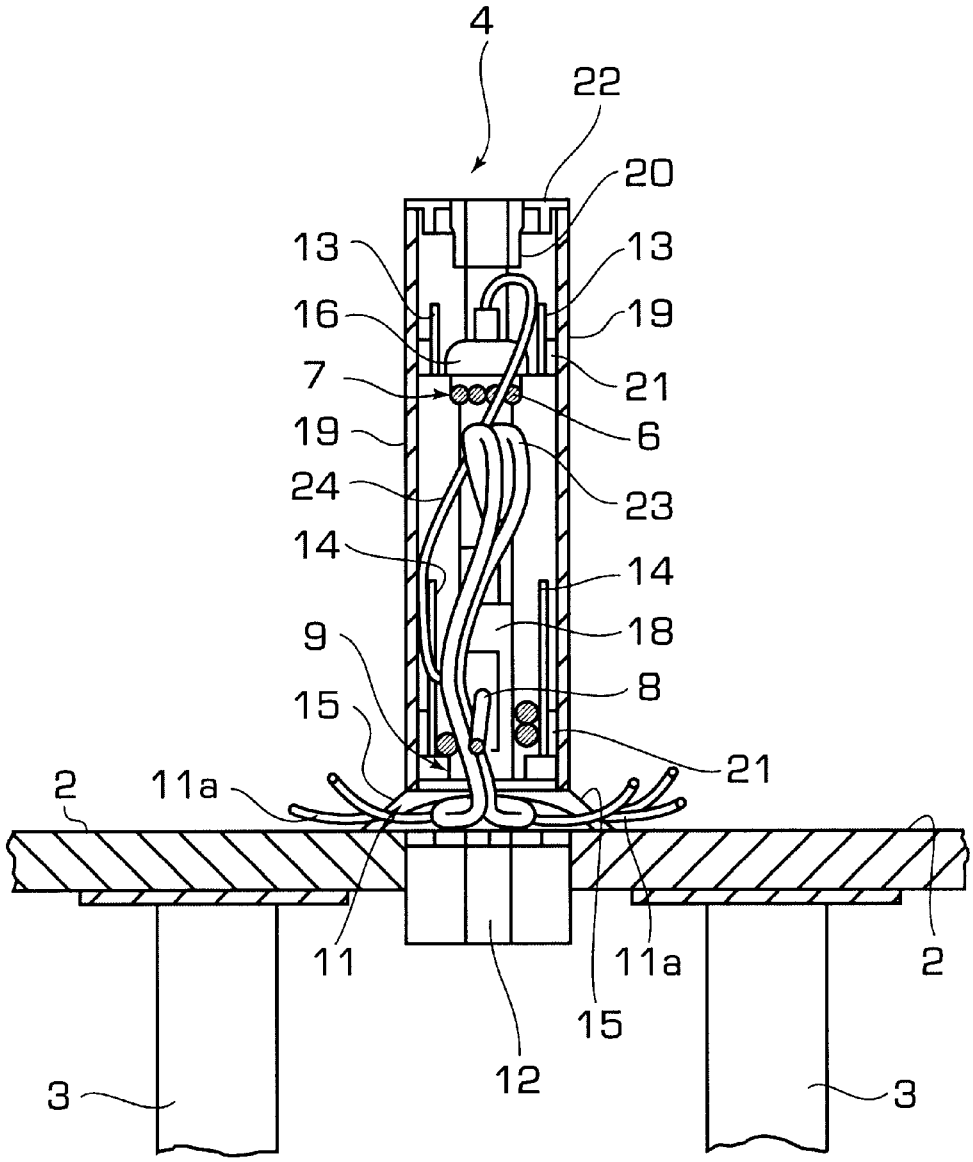
FIG. 6 is a sectional view showing the back board shown in FIG. 5 in greater enlargement.

As shown in FIG. 5 and FIG. 6, protective cover 19 is provided on back board 4 for covering the entire surface of both sides of first cable accommodating part 7 and second cable accommodating part 9. Protective cover 19 is both hung and secured on the ends of retaining parts 20 provided on the upper portion of back board 4 and secured by Velcro (trademark) 21 (see FIG. 6) to the sides of each cable accommodating members 7*a* and 9*a* (see FIG. 4). In addition, top cover 22 is provided on top of back board 4 to cover the top of back board 4. Top cover 22 is configured so as to be held by retaining members 20, and top cover 22 is secured to back board 4 by insertion into retaining members 20. In addition to desktop 2 shown in FIG. 5, FIG. 6 shows desktop 2 arranged opposite to the other side of back board 4.

The work of arranging the various cables in the computer desk device of this embodiment will be explained below with reference to FIGS. 4 to 6.

When wiring the various cables in the computer desk device, top cover 22 (see FIG. 5) attached to back board 4 is first removed. Protective cover 19 (see FIG. 5) secured by Velcro 21 (see FIG. 6) is then pulled away from first cable accommodating part 7 and second cable accommodating part 9, and then lifted up from back board 4 and removed from retaining members 20 (see for example FIG. 5).

Common power supply cable 6 and power supply tap 16 are next installed in first cable accommodating part 7 as shown in FIG. 4. At this time, common power supply cable 6 is disposed in depression 7*b* of cable accommodating member 7*a*, and power supply tap 16 is disposed on the stepped portion of cable accommodating member 7*a*. As a result, since power supply tap 16 does not lie directly upon common power supply cable 6, the positioning of power supply tap 16 is thereby stabilized, making the insertion of plug socket 23 into power supply tap 16 easier. In addition, common network cable 8 and network junction box 18 are arranged in second cable accommodating part 9. At this time, common network cable 8 is arranged in depression 9*b* of cable accommodating member 9*a*. The position of network junction box 18 is also stabilized for the same reason as described above with respect to power supply tap 16, and the connection of network cables 23 to network junction box 18 is thus facilitated. Maintenance of back board 4 become easier because common power supply cable 6 and common network cable 8 are separately arranged inside back board 4.

Guide members 13 and 14 are arranged in each of cable accommodating parts 7 and 9, and cable 6 and 8 can thus be kept from falling out of cable accommodating parts 7 and 9 when arranging cable 6 and 8 in each of cable accommodating parts 7 and 9.

Power supply cable 24 connected to computer 5 (see FIG. 3) is next passed through opening 11*a* of surplus cable length accommodating part 11, through the passage hole in the bottom of cable accommodating member 9*a*, and through the passage hole in the bottom of cable accommodating member 7*a* to connect plug socket 17 power supply tap 16. In addition, network cables 23 connected to computer 5 are passed into opening 11*a* of surplus cable length accommodating part 11, and through a passage hole in the bottom of cable accommodating member 9*a* to be connected to network junction box 18.

After the completion of arranging each of cable 6, 8, 23, and 24, surplus cable length 10 of these cables is accommodated within surplus cable length accommodating part 11, whereby cables are better organized inside back board 4.

As described hereinabove, opening 11*a* is provided in the surface of surplus cable length accommodating part 11 that faces desktop 2, and this opening 11*a* is covered by cover member 15 made of an elastic material. Flexible deformation of cover member 15 can allows each of the cables to be easily led out from surplus cable length accommodating part 11. In addition, opening 11*a* is substantially of the same width as back board 4, thereby allowing cables to be led out from any position in opening 11*a*. Accordingly, cables can be freely arranged depending on the layout of the computer desk device and the arrangement of computers.

Finally, the top of protective cover 19 is again set in retaining members 20, and protective cover 19 is secured to the sides of each of cable accommodating members 7*a* and 9*a* (see FIG. 4) by, for example, Velcro 21 as shown in FIG. 5 or FIG. 6. Top cover 22 is then set into retaining members 20 and secured to back board 4. The task of arranging the various cables in the computer desk device is thus completed.

Figure 7:
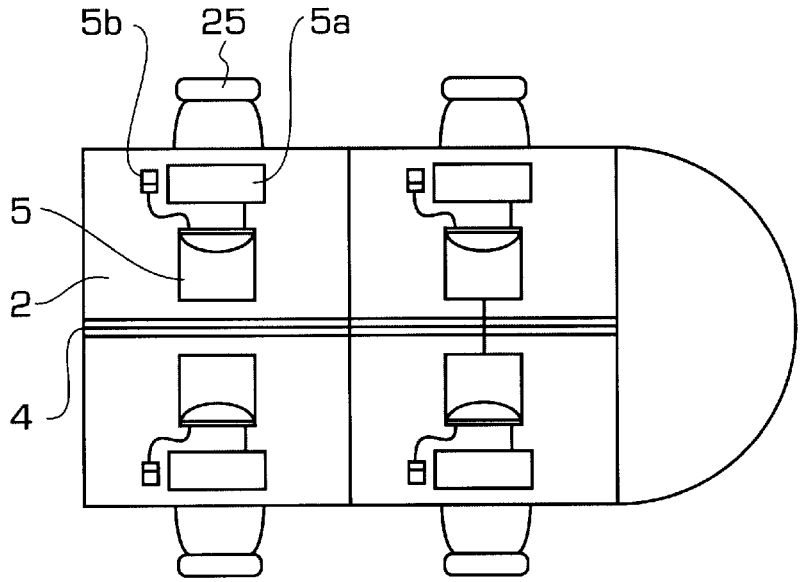
FIG. 7 is a plan view showing an example of an arrangement of a plurality of the computer desk devices shown in FIG. 3.
Figure 8:
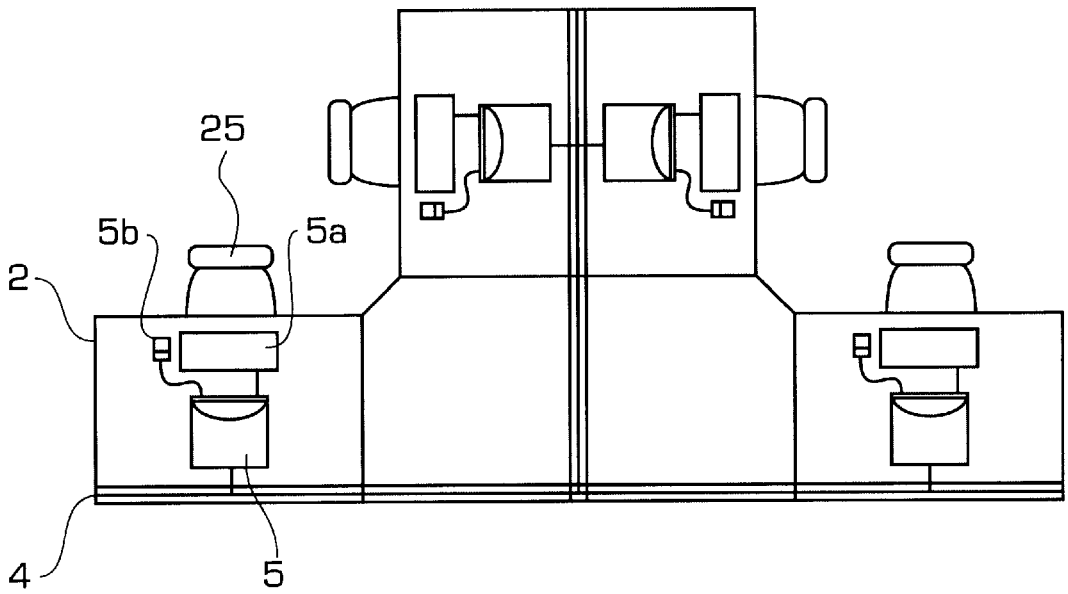
FIG. 8 is a plan view showing another example of an arrangement of a plurality of computer desk devices shown in FIG. 3.

As shown in FIG. 7 and FIG. 8, a plurality of computer desk devices of this embodiment can be aligned side by side or placed back to back. In this case, a chair 25 may be equipped in front of each computer desk device. In addition, the arrangement of fan-shaped desks, semicircular desks, or desks of other shapes between the computer desk devices allows free desk layout within the office floor space. An arrangement in which computer desk devices are placed back to back allows a construction in which back board 4 is provided on only one of the computer desk devices.

As described hereinabove, the computer desk device of the present embodiment provides back board 4, in which are accommodated the various cable 6, 8, 23, and 24 and network junction box 18. Computer 5 installed on desktop 2 and back board 4 are therefore in proximity to each other, and cables in the periphery of computer 5 can be easily organized. In addition, the ease of wiring cables is improved because each cable is led out from back board 4 on desktop 2 and connected to computer 5 or to another computer desk device. Network junction box 18 accommodated inside back board 4 is readily exposed by simply removing protective cover 19 of back board 4, and maintenance of network junction box 18 is therefore facilitated.

The present invention obviates the preparatory construction work on the floor or below the floor surface that was required in the prior art, thereby enabling a reduction in wiring labor and expense and greatly reducing the time necessary for wiring work. Computer desks can therefore be freely arranged within the floor space without consideration for wiring routes in or on the floor, and alterations of the desk layout can be flexibly accommodated.

In the foregoing explanation, an example of back board 4 was described in which first cable accommodating part 7, second cable accommodating part 9, and surplus cable length accommodating part 11 were distinguished. The back board is not limited to this construction, however, and a construction may be adopted in which, for example, only the first cable accommodating part and the second cable accommodating part are provided, the second cable accommodating part is arranged near the desktop, and the various cables are led from the second cable accommodating part to the computer.

Also, in the foregoing explanation, an example was described in which back board 4 is provided as a cable wiring device on the rear side of desktop 2, but back board 4 need not be provided at the rear side of desktop 2, and, for example, may be provided on the bottom surface of desktop 2.

While preferred embodiments of the present invention have been described using specific terms, such description is for illustrative purposes only, and it is to be understood that changes and variations may be made without departing from the spirit or scope of the following claims.

What is claimed is:

1. A computer desk device comprising:

a desktop on which a computer is to be installed;

and a cable accommodating means provided on said desktop for accommodating a plurality of cables to be connected to said computer, wherein said accommodating means includes a first cable accommodating portion and a second accommodating portion, a protective cover to cover an entire surface of both sides of said first cable accommodating portion and said second accommodating portion.

2. A computer desk device according to claim 1 wherein said plurality of cables include at least a common power supply cable for supplying power to said computer and a common network cable to be connected to said computer; and said first cable accommodating portion for accommodating said common power supply cable and said second cable accommodating portion for accommodating said common network cable provided in said cable accommodating means on said desktop.

3. A computer desk device according to claim 2 wherein said second cable accommodating portion includes a network junction box to be connected to said common network cable and also to be connected to said computer.

4. A computer desk device according to claim 2 wherein said first cable accommodating portion and said second cable accommodating portion are each made up of a cable accommodating member having a generally U-shaped cross-section; and a stepped portion that forms a depression that accommodates said common power supply cable or said common network cable is formed in the bottom of said cable accommodating member.

5. A computer desk device according to claim 1 wherein said cable accommodating means includes a surplus cable length accommodating portion for accommodating the surplus portion of the length of said plurality of cables.

6. A computer desk device according to claim 1 wherein said cable accommodating means includes an opening for leading said plurality of cables out of said cable accommodating means or for introducing an external cable to be connected to said plurality of cables into said cable accommodating means.

7. A computer desk device according to claim 6 wherein said opening is of substantially the same width as said cable accommodating means in a direction along one edge of said desktop.

8. A computer desk device according to claim 6 wherein said cable accommodating means includes a cover member formed of an elastic material for covering said opening.

9. A computer desk device according to claim 1 wherein said desk device includes a surplus cable length accommodating portion for accommodating the surplus portion of the length of said plurality of cables in said cable accommodating means in the vicinity of said desktop; and an opening for leading said plurality of cables out of said cable accommodating means and for introducing external cables to be connected to said plurality of cables into said cable accommodating means in said surplus cable length accommodating portion.

10. A means for accommodating cables on a desktop comprising:

a first cable accommodating portion on said desktop for accommodating at least one common power supply cable;

a second cable accommodating portion on said desktop for accommodating at least one common network cable;

a network junction box provided in said second accommodating portion for connecting to said at least one common network cable and a computer on said desktop; and a protective cover on said desktop for containing said first and said second cable accommodating portions;

wherein said first and said second cable accommodating portion are each made up of a cable accommodating member having a generally U-shaped cross-section and a stepped portion forming a depression that accommodates said at least one common power supply cable and said common network cable in the bottom of said cable accommodating means.

* * * * *